US010677032B1

(12) United States Patent
Norton

(10) Patent No.: US 10,677,032 B1
(45) Date of Patent: Jun. 9, 2020

(54) ELECTRIC SUBMERSIBLE PUMP INTAKE SYSTEM, APPARATUS, AND METHOD

(71) Applicant: Halliburton Energy Services, Inc., Houston, TX (US)

(72) Inventor: Brian Alan Norton, Wasilla, AK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 231 days.

(21) Appl. No.: 15/792,525

(22) Filed: Oct. 24, 2017

Related U.S. Application Data

(60) Provisional application No. 62/412,382, filed on Oct. 25, 2016.

(51) Int. Cl.

| | |
|---|---|
| ***E21B 43/12*** | (2006.01) |
| ***E21B 34/14*** | (2006.01) |
| ***E21B 34/10*** | (2006.01) |
| ***F04D 13/10*** | (2006.01) |
| ***E21B 34/06*** | (2006.01) |

(Continued)

(52) U.S. Cl.
CPC ..... *E21B 43/128* (2013.01); *E21B 34/06* (2013.01); *E21B 34/10* (2013.01); *E21B 34/14* (2013.01); *F04D 13/10* (2013.01); *E21B 34/00* (2013.01); *E21B 43/082* (2013.01); *E21B 43/126* (2013.01); *E21B 43/38* (2013.01);
(Continued)

(58) Field of Classification Search
CPC ..... F04D 13/10; F04D 29/708; E21B 43/128; E21B 34/00; E21B 34/06; E21B 34/10; E21B 2034/007; E21B 34/14
See application file for complete search history.

(56) References Cited

U.S. PATENT DOCUMENTS

| | | | |
|---|---|---|---|
| 47,011 | A | 3/1865 | Greenleaf |
| 3,267,869 | A | 8/1966 | Vartapetov et al. |

(Continued)

FOREIGN PATENT DOCUMENTS

EP 0877165 A2 11/1998

OTHER PUBLICATIONS

Baker Hughes Incorporated, "ESP Gas-Avoiding Intakes," Product Brochure, 2012, 1 page.

(Continued)

*Primary Examiner* — Peter J Bertheaud
(74) *Attorney, Agent, or Firm* — McGuireWoods, LLP

(57) ABSTRACT

An electric submersible pump (ESP) intake system, apparatus and method is described. An ESP intake system includes a filtered intake section coupled adjacently to a sliding sleeve intake section, wherein the sliding sleeve intake section has a closed initial state and is selectively actuatable to an open position when the filtered intake section becomes at least partially clogged. An ESP intake method includes operating an ESP pump downhole in a well including abrasive-laden fluid, the ESP pump including a filtered intake section and an actuatable intake section, employing the filtered intake section as a first fluid entrance into the ESP pump, monitoring information from ESP sensors during employment of the first fluid entrance to identify clogging of the filtered intake section, and opening the actuatable intake section upon the clogging so identified such that the actuatable intake section serves as a second fluid entrance into the ESP pump.

20 Claims, 7 Drawing Sheets

(51) Int. Cl.

| | |
|---|---|
| *E21B 43/38* | (2006.01) |
| *E21B 43/08* | (2006.01) |
| *F04D 13/08* | (2006.01) |
| *F04D 29/70* | (2006.01) |
| *E21B 34/00* | (2006.01) |

(52) U.S. Cl.
CPC ..... *E21B 2034/007* (2013.01); *F04D 13/08* (2013.01); *F04D 29/701* (2013.01); *F04D 29/708* (2013.01)

(56) References Cited

U.S. PATENT DOCUMENTS

| | | | | |
|---|---|---|---|---|
| 3,404,924 | A | 10/1968 | Choate | |
| 4,014,387 | A | 3/1977 | Fink | |
| 4,101,423 | A | 7/1978 | Merrill et al. | |
| 4,134,454 | A * | 1/1979 | Taylor | E21B 34/10 137/629 |
| 4,330,306 | A | 5/1982 | Salant | |
| 4,425,965 | A * | 1/1984 | Bayh, III | E21B 23/02 166/106 |
| 4,453,599 | A * | 6/1984 | Fredd | E21B 33/1294 166/150 |
| 5,112,483 | A | 5/1992 | Cluff | |
| 5,588,486 | A | 12/1996 | Heinrichs | |
| 5,845,709 | A | 12/1998 | Mack et al. | |
| 6,379,127 | B1 | 4/2002 | Andrews et al. | |
| 6,394,183 | B1 | 5/2002 | Schrenkel et al. | |
| 6,715,556 | B2 | 4/2004 | Mack et al. | |
| 6,723,158 | B2 | 4/2004 | Brown et al. | |
| 6,755,250 | B2 | 6/2004 | Hall et al. | |
| 7,086,473 | B1 | 8/2006 | Bangash | |
| 7,219,743 | B2 * | 5/2007 | Wolters | E21B 34/101 166/105 |
| 7,270,178 | B2 | 9/2007 | Selph | |
| 7,549,849 | B2 | 6/2009 | Watson et al. | |
| 7,921,908 | B2 | 4/2011 | Tetzlaff et al. | |
| 7,980,314 | B2 | 7/2011 | Mack | |
| 8,012,243 | B2 | 9/2011 | Saville | |
| 8,522,887 | B1 * | 9/2013 | Madison | E21B 34/14 166/386 |
| 8,556,580 | B2 | 10/2013 | Stair et al. | |
| 8,684,679 | B2 | 4/2014 | Tetzlaff et al. | |
| 8,747,078 | B2 | 6/2014 | Brown et al. | |
| 8,863,849 | B2 * | 10/2014 | Patel | E21B 43/128 166/373 |
| 8,919,432 | B1 | 12/2014 | Tetzlaff et al. | |
| 2006/0011345 | A1 | 1/2006 | Delaloye et al. | |
| 2011/0097223 | A1 | 4/2011 | Verichev et al. | |
| 2012/0255738 | A1 * | 10/2012 | Lauderdale | E21B 34/063 166/373 |
| 2013/0233563 | A1 * | 9/2013 | Bussear | E21B 34/10 166/373 |
| 2013/0319956 | A1 | 12/2013 | Tetzlaff et al. | |
| 2015/0064034 | A1 * | 3/2015 | Davis | E21B 43/128 417/423.9 |
| 2018/0171763 | A1 * | 6/2018 | Malbrel | E21B 34/063 |

OTHER PUBLICATIONS

Mott Corporation, "Porous metal solutions," Product Brochure, taken from http://www.mottcorp.com/resource/pdf/pmover.pdf, Aug. 12, 2010, 16 pages.

Takacs, Gabor, "Use of ESP Equipment in Special Conditions," Electrical Submersible Pumps Manual: Design, Operations, and Maintenance, 2009, Gulf Professional Publishing, Burlington, MA, 163, 2 pages.

* cited by examiner

METHOD FOR ELECTRIC SUBMERSIBLE PUMP INTAKE

ELECTRIC SUBMERSIBLE PUMP INTAKE SYSTEM, APPARATUS, AND METHOD

CROSS REFERENCE TO RELATED APPLICATIONS

This application claims the benefit of U.S. Provisional Application No. 62/412,382 to Norton, filed Oct. 25, 2016 and entitled "ELECTRIC SUBMERSIBLE PUMP INTAKE SYSTEM, APPARATUS, AND METHOD," which is hereby incorporated by reference in its entirety.

BACKGROUND OF THE INVENTION

1. Field of the Invention

Embodiments of the invention described herein pertain to the field of electric submersible pumps. More particularly, but not by way of limitation, one or more embodiments of the invention enable an electric submersible pump intake system, apparatus, and method.

2. Description of the Related Art

Fluid, such as gas, oil or water, is often located in underground formations. In situations when pressure within the well is not enough to force fluid out of the well, the fluid must be pumped to the surface so that it can be collected, separated, refined, distributed and/or sold. Centrifugal pumps are typically used in electric submersible pump (ESP) applications for lifting well fluid to the surface. Centrifugal pumps impart energy to a fluid by accelerating the fluid through a rotating impeller paired with a stationary diffuser, together referred to as a "stage." In multistage centrifugal pumps, multiple stages of impeller and diffuser pairs may be used to further increase the pressure lift. The stages are stacked in series around the pump's shaft, with each successive impeller sitting on a diffuser of the previous stage.

Conventionally, well fluid enters the ESP assembly through an intake section. A typical intake section is attached to the ESP assembly below the pump, and consists of a hollow cylindrical chamber with intake ports spaced around the chamber's outer diameter. Well fluid enters the pump assembly through the intake ports and is lifted by the pump stages to the well's surface.

Many underground formations contain well born solids, such as consolidated and unconsolidated sand, which can cause abrasive or erosive damage to the ESP assembly. Production fluid passes these abrasives on its way to the pump intake and carries them into and through the pump assembly. Such well-born solids can have severe abrasive effects on the ESP components and increase heat generated during operation. As a result, careful attention to fluid management in submersible pumps is required in order to prevent pump damage or a shortened operational lifetime of the ESP.

One conventional approach to handling abrasive-laden well fluid is to employ an intake screen. Typically the intake screen surrounds the intake ports and blocks larger solids from passing into the pump. However, these intake screens have a limited surface area and quickly become scaled, clogged, or otherwise obstructed over time. An obstructed intake screen can result in loss, and eventual cessation, of fluid flow into the pump. Low flow rates may result in pump starvation, which can cause pump failure.

Attempts have been made to address the problem of clogged and scaled intake screens. For example, some conventional intake screens include backwashing systems to remove solids clogging the screen. Other cleaning systems have also been developed that attempt to mechanically or electrically loosen and remove solids from the intake screen. These approaches, however, are expensive and often require complicated operating procedures. For example, conventional methods of cleaning an intake screen may require controlling backwashing fluids through several flow paths or rotating the screen itself.

Some types of wells, such as hydraulically fractured wells, have a particularly high concentration of abrasive solids. In fractured wells, proppants are injected into the well and mix with the well fluid entering the pump. The conventional intake screen becomes irreparably clogged almost immediately after start-up, leading to the industry practice of employing a "sacrificial" clean out pump assembly. In these scenarios, the first pump assembly employed, exposed to a high concentration of proppant or other abrasives, is damaged beyond use, pulled from the well, and discarded in favor of a second pump placed only after the proppant concentration has decreased. Sacrificing an entire pump assembly significantly increases the cost of production and causes delays in the process, especially during the transition between pump assemblies.

As is apparent from the above, currently available ESP intakes are not well-suited for operation in modern wells that contain high concentrations of proppant, sand or other abrasives. Therefore, there is a need for an improved ESP intake system, apparatus and method.

BRIEF SUMMARY OF THE INVENTION

One or more embodiments of the invention enable an electrical submersible pump (ESP) intake system, apparatus, and method.

An ESP intake system, apparatus, and method is described. An illustrative embodiment of an electric submersible pump (ESP) assembly includes a multi-stage centrifugal pump fluidly coupled to an ESP intake system, the ESP intake system including a first intake section including a filter and a first fluid entrance, wherein fluid entering the ESP intake system through the first fluid entrance passes through the filter before flowing into the ESP pump, and a second intake section secured adjacently to the filtered intake section, the second intake section including a second fluid entrance, the second fluid entrance actuatable between a closed position, wherein when the second fluid entrance is in the closed position, the fluid flows through the first fluid entrance into the multi-stage centrifugal pump, and an open position, wherein when the second fluid entrance is in the open position, the fluid flows through the second fluid entrance into the multi-stage centrifugal pump. In some embodiments, the second intake section includes a sleeve slideable between the closed position and the open position. In certain embodiments, the ESP assembly includes a pressurizing pump hydraulically coupled to the sleeve by a hydraulic hose, the pressurizing pump adjusting a pressure of a space above the sliding sleeve to actuate the second fluid entrance between the closed position and the open position. In some embodiments, the second intake section includes a spring compressed below the sleeve in the closed position such that the second fluid entrance fails open. In certain embodiments, the filter includes one of a slotted or perforated screen. In some embodiments, the filter includes a porous media cartridge. In certain embodiments, the ESP assembly includes an ESP motor rotatably coupled to the multi-stage centrifugal pump upstream of the ESP intake, the ESP motor operated by a variable speed drive (VSD), the VSD including a VSD controller user-interface, wherein actuation of the second fluid entrance is selectable by an operator, and wherein the VSD controller user-interface provides information determinative of the selection. In some embodiments, the information includes one of flow rate of the multi-stage centrifugal pump, ESP pressure or a combination thereof. In certain embodiments, the information is provided to the VSD controller user-interface from downhole sensors proximate the ESP motor, the downhole sensors electrically coupled to the VSD controller user-interface.

An illustrative embodiment of an electric submersible pump (ESP) intake system includes a filtered intake section in tandem with a sliding sleeve intake section, wherein the sliding sleeve intake section has a closed initial state and is selectively actuatable to an open position when the filtered intake section becomes at least partially clogged, and the filtered intake serving as a fluid intake to an ESP pump when the sliding sleeve intake is in the closed initial state, and the sliding sleeve intake serving as the fluid intake to the ESP pump when the sliding sleeve is in the open position. In some embodiments, the filtered intake section and the sliding sleeve intake section are coupled between the ESP pump and an ESP motor in a hydraulically fractured well. In certain embodiments, the filtered intake section becomes at least partially clogged by proppant. In some embodiments, the ESP intake system further includes a hydraulic pump at a surface of the hydraulically fractured well, wherein the sliding sleeve intake is actuated between the closed initial state and the open position by the hydraulic pump. In some embodiments, the hydraulic pump is operatively coupled to a variable speed drive (VSD) controller, the VSD controller varying one of a frequency, a speed or a combination thereof of the ESP motor. In certain embodiments, the filtered intake section and the sliding sleeve intake section are located in a vertical downhole ESP assembly, and the filtered intake section is attached below the sliding sleeve intake section. In some embodiments, there are a plurality of filtered intake sections and a plurality of sliding sleeve intake sections coupled together in tandem.

An illustrative embodiment of an electric submersible pump (ESP) intake method includes operating an ESP pump downhole in a well including abrasive-laden fluid, the ESP pump including a filtered intake section including a filter, and an actuatable intake section, the actuatable intake section in a closed position during initial operation of the ESP pump and actuatable open, employing the filtered intake section as a first fluid entrance into the ESP pump, monitoring information from ESP sensors during employment of the first fluid entrance to identify clogging of the filter, and opening the actuatable intake section upon the clogging so identified such that the actuatable intake section serves as a second fluid entrance into the ESP pump. In some embodiments, the actuatable intake section includes intake ports and is actuatable open by aligning apertures in a sliding sleeve of the actuatable intake section with the intake ports. In certain embodiments the ESP intake method includes hydraulically actuating the sliding sleeve using a hydraulic pump at a surface of the well. In some embodiments, the information is monitored using a VSD controller user-interface.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
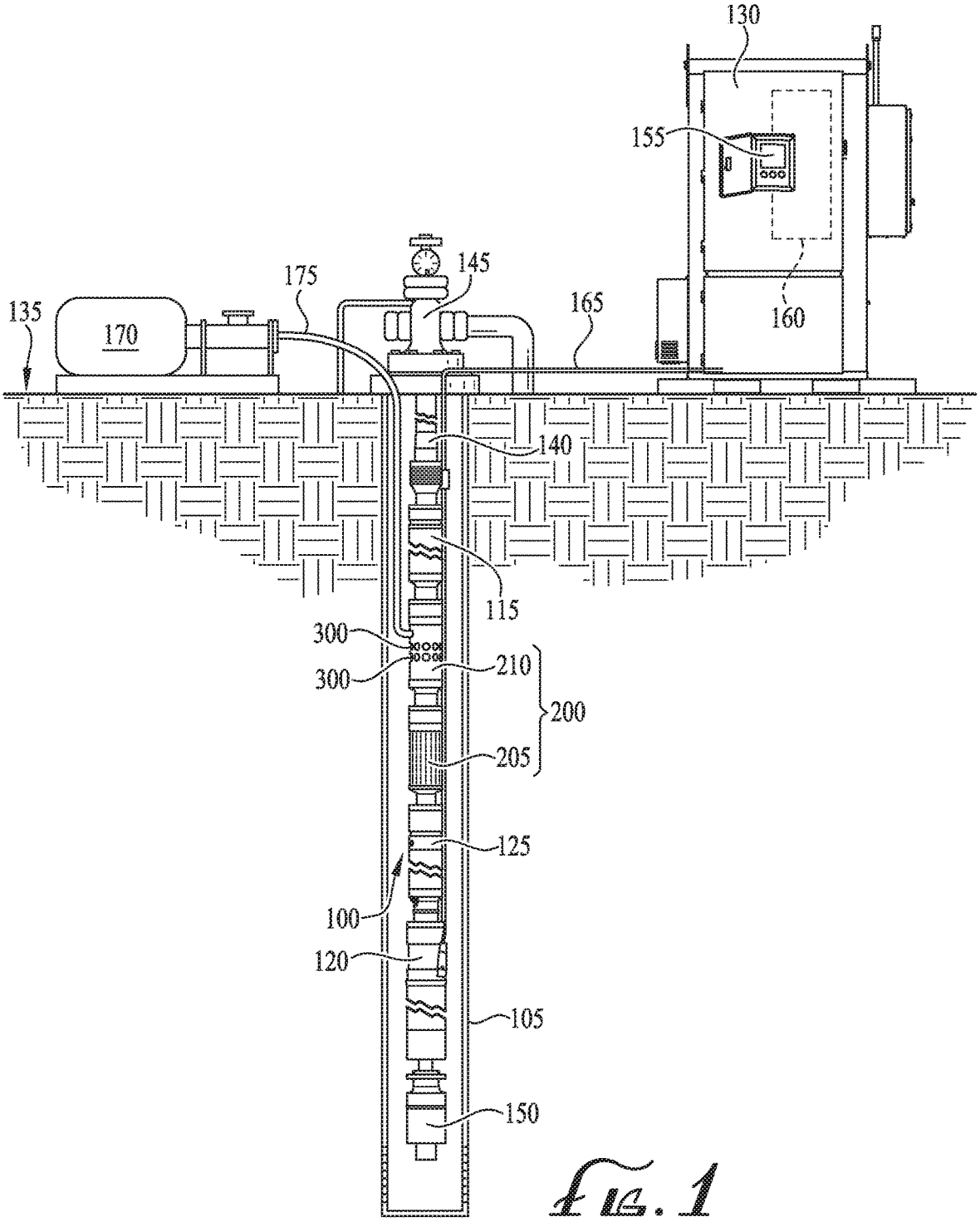
FIG. 1 is a perspective view of an exemplary electric submersible pump (ESP) assembly having an ESP intake system of an illustrative embodiment.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

An electric submersible pump (ESP) intake system, apparatus, and method are described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms “a”, “an” and “the” include plural referents unless the context clearly dictates otherwise. Thus, for example, reference to an intake section includes one or more intake sections.

“Coupled” refers to either a direct connection or an indirect connection (e.g., at least one intervening connection) between one or more objects or components. The phrase “directly attached” means a direct connection between objects or components.

As used herein, the term "outer," "outside" or "outward" means the radial direction away from the center of the shaft of the ESP and/or the opening of a component through which the shaft would extend.

As used herein, the term "inner", "inside" or "inward" means the radial direction toward the center of the shaft of the ESP and/or the opening of a component through which the shaft would extend.

As used herein the terms "axial", "axially", "longitudinal" and "longitudinally" refer interchangeably to the direction extending along the length of the shaft of an ESP assembly component such as an ESP intake, multi-stage centrifugal pump, gas separator or charge pump.

As used in this specification and the appended claims, "downstream" or "upwards" refer interchangeably to the longitudinal direction substantially with the principal flow of lifted fluid when the pump assembly is in operation. By way of example but not limitation, in a vertical downhole ESP assembly, the downstream direction may be towards the surface of the well. The "top" of an element refers to the downstream-most side of the element, without regard to whether the element is oriented horizontally, vertically or extends through a radius. "Above" refers to an element located further downstream than the element to which it is compared.

As used in this specification and the appended claims, "upstream" or "downwards" refer interchangeably to the longitudinal direction substantially opposite the principal flow of lifted fluid when the pump assembly is in operation. By way of example but not limitation, in a vertical downhole ESP assembly, the upstream direction may be opposite the surface of the well. The "bottom" of an element refers to the upstream-most side of the element, without regard to whether the element is oriented horizontally, vertically or extends through a radius. "Below" refers to an element located further upstream than the element to which it is compared.

For ease of description, the illustrative embodiments described herein are described in terms of an ESP assembly. However, the intake system of illustrative embodiments may be applied to any submersible pump exposed to well-born solids. For example, the intake system of illustrative embodiments may be applied to axial-flow pumps, radial-flow pumps, mixed-flow pumps, horizontal pumps, horizontal surface pumps, centrifugal pumps and/or turbine regenerative pumps.

Illustrative embodiments provide an ESP intake system and method that may improve survivability and/or run life of an ESP in wells with significant solid content and/or with high initial solid content that tapers off over time, such as in post fractured wells. Illustrative embodiments may advantageously eliminate the need for backwash systems, intake cleaning systems, and/or "sacrificial" clean out pumps. Additionally, illustrative embodiments may avoid the need for intake screen replacement and the associated delays and lost revenues resulting from pulling the entire ESP assembly from the well for the replacement. Illustrative embodiments may be particularly advantageous in locations where well intervention costs are high or in remote areas where rig availability is sparse. Illustrative embodiments may be used independently without the need for other produced solid treatment or may be used in conjunction with scale inhibition treatments, acidizing treatments, an ESP bypass system and/or a coiled tubing clean out to further increase the run life of the ESP assembly.

The ESP intake of illustrative embodiments may include a filtered intake section and an actuating intake section cooperating in tandem to filter damaging abrasives and maintain flowrate of produced fluid. In an exemplary embodiment, the filtered intake section may be a screened intake, and the actuating intake section may be a sliding sleeve intake. During initial operation of the ESP assembly and/or when the concentration of solids in the produced fluid is high, the actuating intake section may be closed and the filtered intake section may serve as the intake for the ESP pump. Once the filtered intake section becomes clogged to the extent the flow rate is sufficiently affected (low), the actuating intake section may be opened to bypass the filtered intake section and serve as the intake for the ESP pump. In this manner, flow rate may be maintained while abrasive and erosive protection to the pump may be provided when it is most needed, such as when solid content is high and/or during initial startup.

Illustrative embodiments may include an artificial lift assembly, such as an ESP assembly, which may be located downhole below the surface of the ground. FIG. 1 shows an exemplary ESP assembly 100. ESP assembly 100 may be positioned within well casing 105, which well casing 105 may separate ESP assembly 100 from an underground formation. Casing 105 may include perforations above or below ESP pump 115, for entry of well fluid inside casing 105. Motor 120 may turn ESP pump 115 and may, for example, be a two-pole, three-phase squirrel cage induction motor. Seal section 125 may be a motor protector, serving to equalize pressure and keep motor oil separate from well fluid. Intake system 200 may serve as the intake for well fluid into ESP pump 115. ESP Pump 115 may be a multi-stage centrifugal pump and may lift fluid to surface 135. Production tubing 140 carries produced fluid to wellhead 145, and then into a pipeline, storage tank, transportation vehicle and/or other storage, distribution or transportation means.

Intake system 200 may be located between seal section 125 and ESP pump 115 in ESP assembly 100. In some embodiments, intake system 200 may be between seal section 125 and a gas separator (not shown) or between seal section 125 and a charge pump (not shown) located below primary centrifugal ESP pump 115. A gas separator may be employed in gassy wells and may separate gas prior to the gas' entry into ESP pump 115, lower intake pressure, and/or increase drawdown. In some embodiments, a gas separator may be integral to ESP intake system 200. Intake system 200 may include filtered intake section 205 coupled above or below actuating intake section 210.

Downhole sensors 150 may be internally or externally mounted to ESP assembly 100 below, above and/or proximate motor 120. Downhole sensors 150 may monitor and/or provide information to calculate three-phase amps and volts, wellhead pressure, pump intake pressure, casing annulus pressure, flow rate, internal motor temperature, pump discharge pressure, pump discharge temperature, downhole flow rate and/or equipment vibration. Downhole sensors 150 may communicate information to variable speed drive (VSD) 160 by a dedicated wire or a signal imposed on ESP power cable 165 that provides power to ESP motor 120 and connects to a power source on surface 135. Information from downhole sensors 150 may be communicated to an operator on VSD controller user-interface 155.

VSD 160 may reside inside cabinet 130 on well surface 135 and include VSD controller user-interface 155, which may display information to an operator regarding operating and environmental conditions such as temperatures, pressures, and flowrates of ESP assembly 100 and/or produced fluid. Specifically, VSD controller user-interface 155 may display measurements indicative of the operating conditions of ESP intake system 200 such as clogging of filtered intake section 205, and notify an operator of the need to open actuating intake section 210. In some embodiments, VSD 160, controller user-interface 155 and/or a programmable logic controller (PLC) or computer located inside cabinet 130 or remotely may initiate actuation of actuating intake section 210 without the need for intervention by an operator.

Figure 2A:
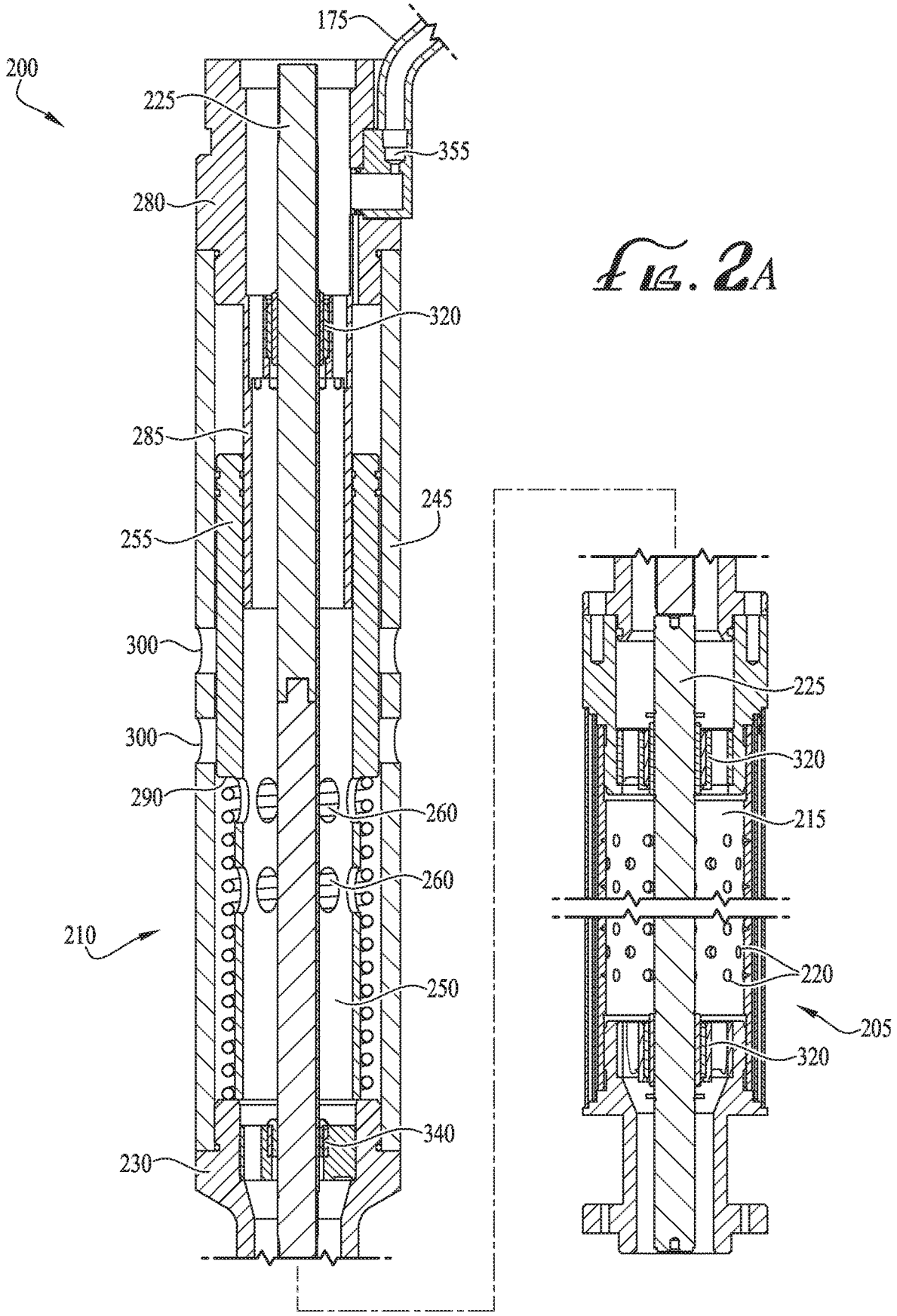
FIG. 2A is cross sectional view of an ESP intake system of an illustrative embodiment with an actuating intake section in a closed position.
Figure 2B:
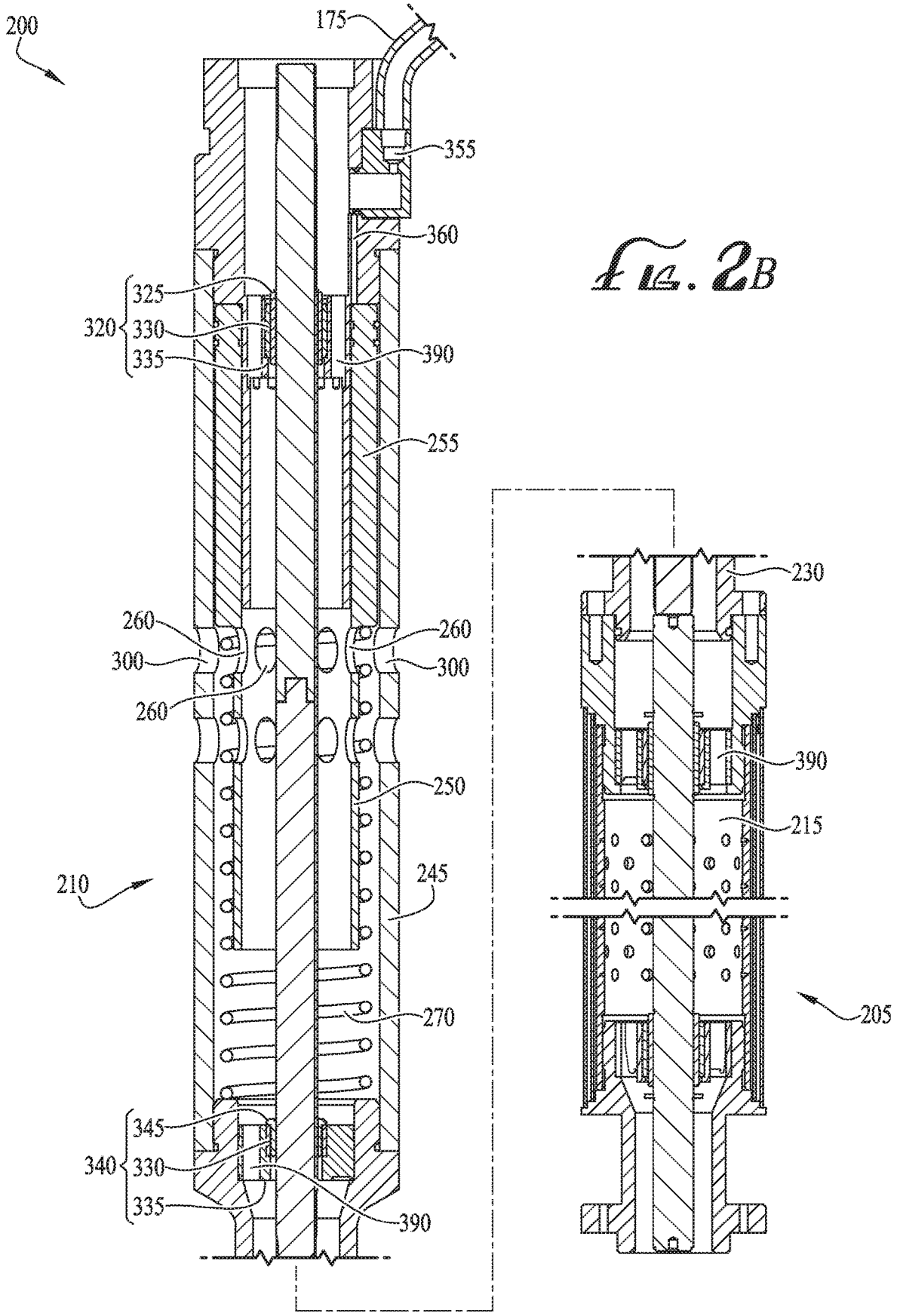
FIG. 2B is a cross sectional view of an ESP intake system of an illustrative embodiment with an actuating intake section in an open position.

FIG. 2A and FIG. 2B illustrate an ESP intake system of illustrative embodiments. ESP intake system 200 may include two or more distinct types of intake sections, which may be employed in succession to maintain and/or improve flow rate of production fluid into and through ESP pump 115. ESP intake system 200 may include filtered intake section 205 in tandem with, attached to and/or coupled to actuating intake section 210. When actuating intake section 210 is closed, filtered intake section 205 may serve as the intake for fluid entering ESP pump 115. Filtered intake section 205 may include filter 215, such as a screen and/or porous media cartridge, which may filter abrasive solids before fluid enters ESP pump 115. Actuating intake section 210 may include ports 300 in housing 245 that may be opened and closed by hydraulic pump 170 (shown in FIG. 1), VSD controller user-interface 155 and/or another control system. A sliding sleeve, a valve, or another similar actuatable feature may open and close intake ports 300 on actuating intake section 210. When actuating intake section 210 is open it may serve as the intake for fluid into ESP pump 115.

Intake system 200 may include at least two distinct intake section types employed in tandem and/or dispersed along ESP assembly 100, with one intake section type selectively employed as the intake of ESP pump 115 to the exclusion of the other section type and/or with one intake type serving as the primary intake of well fluid into ESP pump 115 at any particular time. One or more of each type of intake section 205, 210 may be included in ESP assembly 100 to form intake system 200. Where a plurality of the same type of intake section 205, 210 is employed, for example where a plurality of filtered intake sections 205, the sections may be connected adjacently in series, one above the next, and well fluid may enter each of the plurality of filtered intake sections 205 in parallel. In the example shown in FIG. 2A and FIG. 2B, a first intake section type, filtered intake section 205, and a second intake section type, actuating intake section 210, together form intake system 200. As illustrated, filtered intake section 205 is below actuating intake section 210. In some embodiments, filtered intake section 205 may be above actuating intake section 210.

Filtered intake section 205 may include one or more tubular filters 215 that surround intake shaft 225. Where more than one filter 215 is employed, filters 215 may be concentric to capture solids of decreasing size, or may be arranged one above another to increase the surface area of filter 215 exposed to incoming well fluid. Filter 215 may include and/or be surrounded by a screen with slots or perforations 220, such as a stainless steel and/or wire mesh screen, may be a porous structure such as a metallic porous media cartridge, or may be another type of filter such as a gravel pack or pumice. In perforated and/or slotted embodiments, filtered intake section 205 may have a plurality of circumferentially spaced perforations 220. Perforations 220 in filter 215 may allow production fluid to enter filtered intake section 205 while blocking abrasive solids from entering ESP pump 115. When filtered intake section 205 is employed as the intake for ESP pump 115, fluid may follow filtered intake path 275 shown in FIG. 3A.

Actuating intake section 210 may be any type of intake that includes actuatable ports and/or openings that may be selectively opened and closed. As shown in FIGS. 2A-2B, actuating intake section 210 may include sliding sleeve 250 that opens and closes ports 300 of actuating intake section 210. Sliding sleeve 250 may include and/or be attached to piston 255, which piston 255 may be a section, portion or extension of sliding sleeve 250. In some embodiments, actuating intake section 210 may include actuatable intake ports 300 that may be blocked by rolling spheres or actuatable doors, valves and/or flaps. Actuating intake section 210 may be closed during initial startup of ESP assembly 100 and/or during use of filtered intake section 205, and may be opened to allow production fluid to flow into ESP assembly 100 through actuating intake section 210. FIG. 2A illustrates actuating intake section 210 in a closed position, and FIG. 2B illustrates actuating intake section 210 in an open position. In some embodiments, actuating intake section 210 may be opened once filtered intake section 205 becomes clogged or blocked by solids, abrasives or other media carried by produced well fluid. Actuating intake section 210 may have a fail-open design.

Actuating intake section 210 may include intake ports 300 in intake housing 245 through which production fluid may enter ESP assembly 100 and/or ESP pump 115 when intake ports 300 are open or at least partially open. Sliding sleeve 250 and/or piston 255 may slide axially inside housing 245 in order to block intake ports 300 while in the closed position, and align apertures 260 in sliding sleeve 250 with intake ports 300 when in the open position. Apertures 260 in sliding sleeve 250 may slide axially, move and/or rotate out of or into alignment with ports 300 to close actuating intake section 210 or to open actuating intake section 210, respectively. Head 280 of actuating intake section 210 may include cylindrical wall extension 285 that extends downwards from actuating section head 280, into actuating intake section 210. Cylindrical (tubular) wall extension 285 may extend in between shaft 225 and housing 245 and serve as a guide for piston 255 when piston 255 slides upwards to open ports 300 or downwards to close ports 300. When sliding upwards to open ports 300, piston 255 may slide between housing 245 and cylindrical wall extension 285. Piston 255 and/or a portion of sliding sleeve 250 may include shoulder 290 at the intersection between piston 255 and sliding sleeve 250 and/or the outer diameter of piston 255 may be larger than the outer diameter of sliding sleeve 250. Shoulder 290 may extend over the top of spring 270 and press down on spring 270 to compress spring 270 when sliding sleeve 250 slides downwards to close ports 300, providing a fail-open design. Sliding sleeve 250 below piston 255 and/or shoulder 290 may slide and/or extend inside and/or inward of spring 270 coils. As primarily described herein for ease of description and so as not to obscure the invention, sliding sleeve 250 slides downward to close ports 300, and upwards to open ports 300, but those of skill in the art may appreciate that the direction of the sliding mechanism may equally be reversed.

Figure 3A:
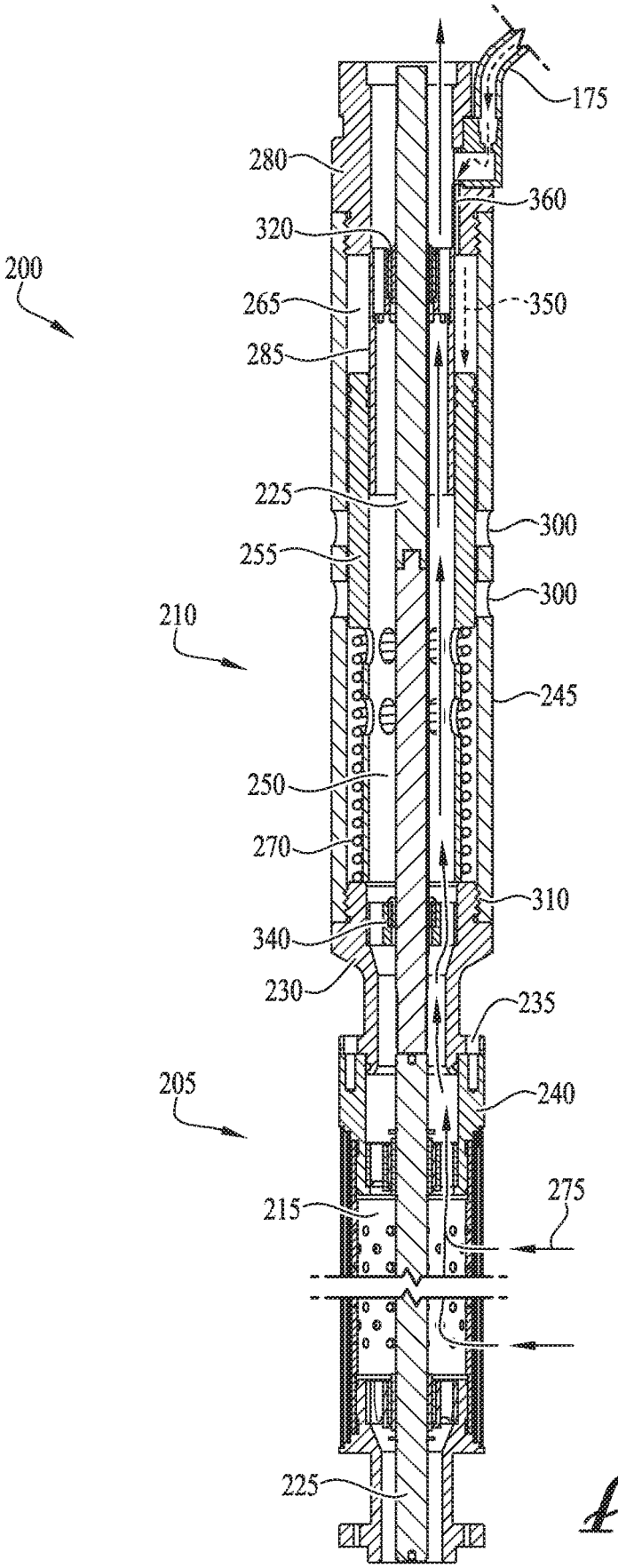
FIG. 3A is cross sectional view of an ESP intake system of an illustrative embodiment with an actuating intake section in a closed position.

Actuation of actuating intake section 210 may be hydraulic, electrical, mechanical, magnetic, pneumatic, and/or gravitational induced actuation. FIG. 3A illustrates hydraulic pressurization of piston 255 and/or sliding sleeve 250 to close ports 300 and/or maintain sliding sleeve 250 in a closed position. Space 265 may be an opening formed between housing 245 and tubular wall extension 285 in a radial direction, and between piston 255 and actuating section head 280 in a longitudinal direction. Space 265 may be fluidly connected to hose 175 to allow pressurizing fluid 350 to flow through hose 175 into space 265 using hydraulic pump 170. Pressurization (increased and/or applied pressure) of space 265 above piston 255, may cause piston 255 and attached sliding sleeve 250 to slide downwards in a position that blocks ports 300 and compresses spring 270. When sliding sleeve 250 is in a closed position, spring 270 located below sliding sleeve 250 may be compressed by sliding sleeve 250 and/or pressure from shoulder 290 directed downwards as sliding sleeve 250 and/or piston 255 moves in same direction. Spring 270 may provide actuating intake section 210 with a fail-open design, ensuring that ports 300 open in the event of a malfunction of actuating intake section 210. Valve 355 (shown in FIG. 3B) may prevent fluid from flowing backwards into hose 175 and/or may prevent hydraulic fluid 350 from leaking into space 365 when hydraulic pump 170 is turned off. Hydraulic pump 170 on surface 135 may pump hydraulic fluid 350 into or out of space 265 inducing movement of piston 255 and/or sliding sleeve 250. Channel 360 for hydraulic fluid 350 may extend through actuating section head 280, outward of the production flow path 275, 305 and/or outward of wall extension 285.

Figure 3B:
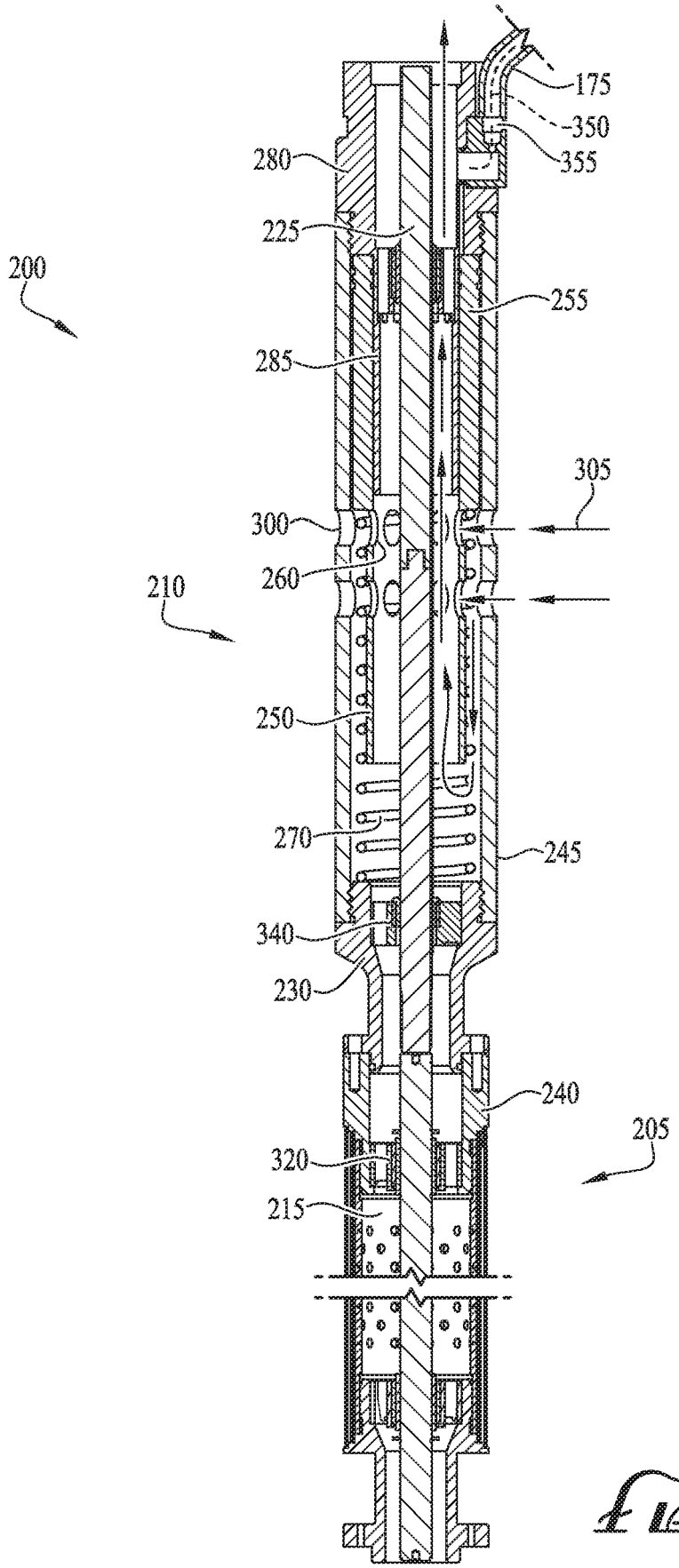
FIG. 3B is a cross sectional view of an ESP intake system of an illustrative embodiment with an actuating intake section in an open position.

FIG. 2B and FIG. 3B illustrate actuating intake section 210 in an open position. To actuate from a closed position to an open position, hydraulic pump 170 may be turned off or operated in reverse, depressurizing space 265. When turned off, hydraulic pump 170 may cease to send hydraulic fluid 350 through hose 175, releasing pressure within space 265. Depressurization, release, reduction and/or removal of pressure from within space 265 may cause piston 255 to move and/or slide upwards to occupy space 265 and/or spring 270 to extend. When actuating intake section 210 is open, apertures 365 of sliding sleeve 250 may align with intake ports 300. The bottom of actuating section head 280 may act as a stopper for piston 255 when ports 300 are open. When ports 300 are open, well fluid may enter actuating intake section 210 following actuating intake flow path 305 shown in FIG. 3B.

Returning to FIG. 1, hydraulic pump 170 may be a single acting hydraulic electric pump with dump control valve, a centrifugal pump or positive displacement pump located on well surface 135 and may be fluidly coupled to actuating intake 210 through valve 355 and hydraulic hose 175, which hose 175 may extend from surface 135, alongside ESP assembly 100, to valve 355 of intake system 200. The pressure inside space 265 may be adjusted by turning hydraulic pump 170 on or off, or in some embodiments adjusting the flowrate of hydraulic pump 170. In some embodiments, hose 175 may be an electric cable and may connect to an electrically, electromagnetically, and/or electromechanically actuated system for opening and closing actuating intake section 210.

FIG. 3A illustrates filtered intake section 205 serving as the intake for fluid into ESP pump 115. Actuating intake 210 may be in a closed position, and fluid may enter ESP pump 115 through filtered intake section 205. In some embodiments, actuating intake section 210 may be closed when a high concentration of solid is present in produced well fluid, and solids may be filtered by filter 215. While in the closed position, well fluid enters intake system 200 solely or primarily through filtered intake section 205. Upon entering filtered intake section 205, production fluid may follow filtered intake flow path 275 through filter 215, through the hollow inside portion of filtered intake 205 around shaft 225, through adapter 230, and then through actuating intake section 210 inward of sliding sleeve 250, spring 270 and/or tubular wall extension 285. Production fluid may be filtered as it flows through filter 215, and before the fluid enters ESP pump 115 to be carried by production tubing 140 to surface 135.

Filtered intake section 205 may be connected and/or coupled to actuating intake section 210 with adapter 230. Adapter 230 may bolt and/or thread to the head or base of filtered intake section 205 and actuating intake section 210. In the example shown in FIG. 3A, bolts 235 connect adapter 230 to filter section head 240 and threads 310 connect adapter 230 to bottom side of housing 245 of actuating intake section 210. In some embodiments, other combinations of threads 310, bolts 235, screws and/or other fastening means may be employed. Adapter 230 may be hollow to allow fluid to traverse between adjacent intake sections within intake system 200. Intake shafts 225 may extend through each intake section 205, 210 of intake system 200. Each intake section 205, 210 may have its own intake shaft 225 splined and/or connected to adjacent intake shafts 225 and rotated by ESP motor 120.

Over time, filter 215 may become clogged, scaled, and/or blocked, which can result in pump 115 starvation. If filtered intake section 205 becomes clogged, or if an alternative intake for ESP pump 115 is otherwise desired, actuating intake section 210 may be actuated to an open position to allow for an alternative flow path for production fluid and uninterrupted or substantially uninterrupted flow into ESP pump 115. FIG. 3B shows actuating intake section 210 in an open position. Hydraulic pump 170 may be turned off, and the flow of pressurization fluid 350 may cease. Pressure in space 265 may therefore be released, allowing spring 270 to extend into its equilibrium position and/or extend until piston contacts actuating section head 280. Decompressing spring 270 may press upwards on shoulder 290, exerting upward force on sleeve 250 and/or piston 255, and opening and/or unblocking intake ports 300. Extension of spring 270 and/or upward movement of sleeve 250 may unblock intake ports 300 and/or align apertures 260 with ports 300 to open actuating intake section 210. Opened ports 300 may bypass and/or supplement filtered intake section 205 if filtered intake section 205 is clogged, partially clogged, malfunctioning, and/or actuating intake section 210 may otherwise supplement or replace filtered intake section 205 as the intake of ESP pump 115. When actuating intake section 210 is open, production fluid may follow actuating flow path 305 which enters inlet ports 300, flows downward between housing 245 and sleeve 250, turns upward to flow inside of sliding sleeve 250, and then flows upward between shaft 225 and sliding sleeve 250 and/or between shaft 225 and tubular wall extension 285 through actuating intake section 210, and continuing towards centrifugal pump 115.

As the length of intake 200 increases by the inclusion of multiple intake sections, one or more thrust and/or radial bearing sets may be spaced along the length of shafts 225 extending through filtered intake section 205, adapter 230 and/or actuating intake section 210. In the example shown in FIG. 2B, shafts 225 include radial bearing sets 320, each including rotatable bearing sleeve 325, which may be keyed or otherwise attached to shaft 225 and may rotate with shaft 225. Bearing sleeve 325 may be rotatable and rotate inside of non-rotating bushing 330. The outer diameter of bushing 330 may be pressed and/or secured into spider bearing 335. Similarly, intake system 200 may include one or more thrust bearing sets 340 including flanged sleeve 345, which rotates with shaft 225 inside of bushing 330. The outer diameter of spider bearing 335 may be pressed into and/or secured to adapter 230, actuating intake section 210 and/or filtered intake section 205. For example, spider bearing may be pressed into tubular wall extension 285, adapter 230 and/or filter section head 240, depending on the location of spider bearing 335. Spider bearing 335 may include openings 390 forming pathways through which fluid entering and/or flowing through intake system 200 may flow on its way to ESP pump 115. Openings 390 through spider bearings 335 should be large enough so as not to impede flowrate of ESP pump 115. Thrust bearing sets 340 and/or radial support bearing sets 320 may be employed as needed based on shaft 225 length, shaft 225 diameter, and the magnitude of thrust and/or radial forces acting on intake system 200.

Actuating intake section 210 may be actuated between a closed position and open position by an operator and/or computer control system. In some embodiments, actuating intake section 210 may be actuated from a closed position to an open position after filtered intake section 205 has been identified as clogged and/or otherwise not maintaining sufficient fluid flow into ESP pump 115 to maintain lower limit flowrate and/or pressure. Measurements from downhole sensors 150 may be displayed on VSD controller user-interface 155 and allow for identification of a clogged and/or malfunctioning filtered intake section 205. For example, measurements obtained from sensors 150, such as pressure sensors and/or flowmeters located downhole, may be displayed on VSD controller user-interface 155 and allow an operator to identify a loss of flow through filtered intake section 205 and proceed to trigger opening of the actuating intake section 210 and/or alert an operator to open actuating intake section 210.

Figure 4:
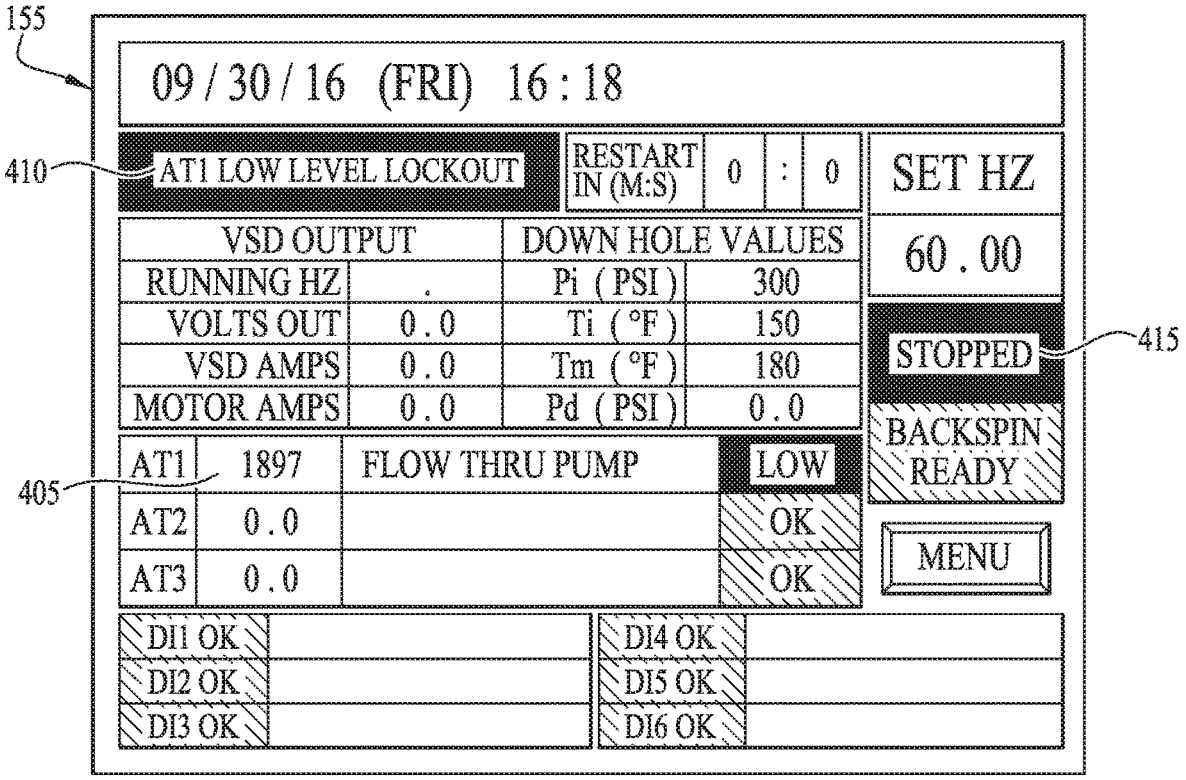
FIG. 4 is a schematic diagram of an exemplary variable speed drive controller user-interface screen of an illustrative embodiment.

FIG. 4 illustrates an exemplary VSD controller user-interface 155 displaying a screen with information that may notify an operator and/or a computer control system of a fault. In the example shown in FIG. 4, VSD controller user-interface 155 displays flow through value 405, which may be used to determine if one or more filtered intake sections 205 have become blocked, clogged, or otherwise malfunctioned so as to stop or reduce flow through ESP pump 115. As shown in FIG. 4, fault alarm 410 indicates a low level lockout, and status identifier 415 indicates that ESP motor 120 has stopped. The flowrate of production fluid through one or more filtered intake sections 205 may be monitored by a programmable logic controller (PLC), computer and/or operator using flow through values 405, which may be used to determine the appropriate time to open ports 300 of actuating intake section 210. An analog in set-up screen may allow setting of a lowest allowable scale value for flow thru, and VSD controller user-interface may indicate a fault or alarm when the lowest allowable value has been reached. An event history may notify and/or provide an operator or computer control system with sufficient information to determine whether ports 300 of actuating intake section 210 should be opened. In FIG. 4, controller user-interface 155 indicates that ESP motor 120 has stopped due to a flow rate that has been previously designated during setup as too low for operation. In such a scenario, an operator and/or computer control system may actuate actuating intake section 210 into an open position by turning off hydraulic pump 170, resetting VSD 160, and/or restarting ESP motor 120 with actuating intake section 210 acting as the intake for ESP assembly 100.

In some embodiments, actuating intake section 210 may be opened prior to ESP motor 120 shutdown to provide an uninterrupted flow of production fluid. In this case, parameters of interest to the identification of a clogged or malfunctioning filtered intake section 205, such as flowrate and/or pressure, may be monitored at regular intervals or continuously by an operator and/or computer during operation employing filtered intake section 205. For example, the flowrate through ESP pump 115 may be monitored through flow values 405 on VSD controller user-interface 155 in order to identify a blocked, partially-blocked, and/or malfunctioning filtered intake section 205 during operation and/or prior to a shutdown set point. Similarly, an operator and/or computer control system may use an event sequence to predict when filtered intake section 205 may become clogged or substantially clogged. In other illustrative embodiments, VSD 160 may shut down operation before an operator and/or computer control system open actuating intake section 210. In this case, an operator and/or computer system may open actuating intake section 210 before or after resetting VSD 160, and then resuming pumping operation. This may allow for a brief interruption of the pumping process, which may be as little as one, two or five minutes depending on alarm response time.

Figure 5:
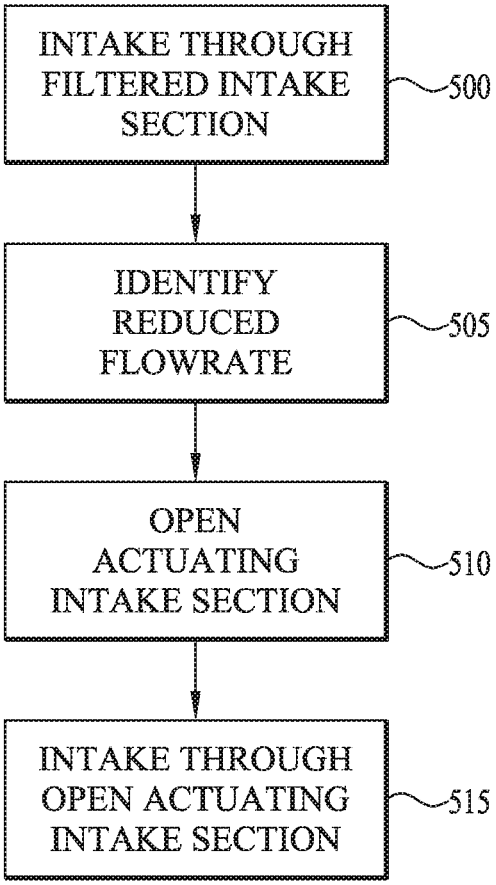
FIG. 5 is a flowchart diagram of an exemplary ESP intake method an illustrative embodiment.

An ESP intake method of illustrative embodiments may increase the run life of an ESP assembly despite high solid content in the well and may improve over conventional methods by allowing well fluid to be filtered while maintaining the flow rate of the production fluid into ESP assembly 100. Additionally, the method of illustrative embodiments may improve over conventional ESP intake methods by shortening or preventing interruption of well production and/or avoiding the need for self-cleaning systems, backwash systems, and/or clean-out pumps. FIG. 5 is a flowchart of an exemplary ESP intake method of an illustrative embodiment. At filtering step 500, production fluid may enter ESP assembly 100 and/or ESP pump 115 through filtered intake section 205, which may filter well-born solids, and actuating intake section 210 may be closed. An operator, downhole sensors 150 and/or VSD system 160 may also monitor the flowrate through filtered intake section 205 during filtering step 500. For example, during filtering step 500, measurements from downhole sensors 150 may be displayed on VSD controller user-interface 155 to identify occurrence of a blocked, clogged, or otherwise malfunctioning filtered intake section 205. Such flowrates may be monitored from the default screen displayed on user-interface 155, shown in FIG. 4, which may be used by an operator and/or similar information may be used by a computer control system to identify a blocked or otherwise malfunctioning filtered intake section 205.

Filtering step 500 may continue until a predetermined lower limit flowrate is reached, at which time an operator and/or computer system may identify a clogged or malfunctioning filtered intake section 205 at identification step 505. Identification of a low flowrate through filtered intake section 205 at identification step 505 may include measurements taken by sensors 150, which may be displayed on VSD controller user-interface 155. Measurements of pressure, flowrate, and/or similar parameters of interest may be ascertained from VSD 160 and/or VSD controller user-interface 155 by an operator and/or computer system, which may use these measurements to determine and/or calculate if filtered intake section 205 is sufficiently clogged, malfunctioning and/or the flow rate of ESP assembly 100 is otherwise too low to continue with the current state of operation. In certain embodiments, such measurement displays may be paired with a computer control system and/or predetermined algorithm in order to automatically identify and/or predict the presence of a blocked, clogged, or damaged filtered intake section 205.

Upon identification of reduced flow rate at identification step 505, an operator and/or computer control system may open actuating intake section 210 at actuation step 510.

Upon opening actuating intake section 210, operation may continue at actuating intake step 515, whereby production fluid may enter ESP pump 115 entirely or substantially through actuating intake section 210. In this way, operation may continue with a brief delay or no delay to well fluid production. Actuating intake step 515 may be used in post fractured wells, where the solid content of the well has decreased such that filtration of produced fluid is no longer necessary and/or a filter 215 may be incorporated into actuating intake section 210 that is only exposed to well fluid after actuating intake section 210 opens. In some embodiments, fluid intake may cease briefly during identification step 505 and the opening of actuation section 510 at step 510, before operation resumes at actuating intake step 515. Such an operation-ceasing procedure may be manual or may be automated and may be triggered by VSD 160 and displayed on VSD controller user-interface 155. In other illustrative embodiments, filtering step 500 may continue throughout identification step 505 and opening of actuation section 210 such that there is no interruption in fluid intake to ESP pump 115 between filtering step 500 and actuating intake step 515.

Illustrative embodiments may optionally include additional features to prolong the serviceable life of ESP assembly 100. For example, cleanout systems may be used to remove particulates from the borehole before operation. In some illustrative embodiments, for example, an ESP bypass system may be used in conjunction with a coiled tubing clean out before filtering step 500, actuated intake step 515, or both, in order to reduce the solids content of fluid entering the pump assembly. Additionally, scale inhibition treatments and/or acidizing treatments may be used to further reduce the damage caused by such wellborn solids. These practices may be especially beneficial in remote locations or in locations where pumping costs are especially high.

Once actuating intake section 210 has been opened it may remain open and serve as the ESP intake for ESP pump 115 for the remainder of operation. In some embodiments, an acidizing treatment, or similar filter clean-out system, may be employed on filtered intake section 205 such that actuating intake section 210 may be closed, and filtered intake section 205 may be re-employed. In such instances, steps 500-515 may be repeated. In this manner, actuating intake section 210 may be opened at opening step 510 and utilized actuating intake step 515 while filtered intake section 205 is undergoing unclogging treatments. After filtered intake section 205 has been sufficiently unclogged, an operator and/or computer control system may return to filtered operation at step 500 by closing actuating intake section 210. Such a process may allow ESP assembly 100 of illustrative embodiments to filter abrasive solids for an extended duration while minimizing the amount of abrasives permitted to enter ESP assembly 100. In certain embodiments, actuating intake section 210 may be only partially opened, or opened with a controlled gradient, such that both filtered intake section 205 and actuating intake section 210 may simultaneously function as the intake for ESP pump 115 to improve flow rate prior to actuating intake section 210 becoming the primary intake for ESP pump 115.

Illustrative embodiments may provide an ESP intake that filters well fluid of abrasive solids while maintaining or substantially maintaining flowrate. Illustrative embodiments may provide an ESP intake that may provide little-to-no interruptions in the fluid production process due to a clogged, blocked, or malfunctioning filter. Illustrative embodiments may provide an improvement over conventional ESP intakes by eliminating the need for self-cleaning systems, backwash systems, or a clean-out pump and/or improving the implementation of such cleaning systems through combination with illustrative embodiments. Illustrative embodiments may provide for an actuating intake section to open and allow production fluid to enter the ESP assembly in the instance of a clogged intake filter.

Illustrative embodiments may provide an ESP intake apparatus, system and method that may provide improved survivability (run life improvement) of an ESP in wells with significant solid content, such as post fracture wells.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. An electric submersible pump (ESP) assembly comprising:

a multi-stage centrifugal pump fluidly coupled to an ESP intake system;

the ESP intake system comprising:

a first intake section comprising a filter and a first fluid entrance, wherein fluid entering the ESP intake system through the first fluid entrance passes through the filter before flowing into an ESP pump; and a second intake section secured adjacently to the first intake section, the second intake section comprising a second fluid entrance, the second fluid entrance actuatable between:

a closed position, wherein when the second fluid entrance is in the closed position, the fluid flows through the first fluid entrance into the multi-stage centrifugal pump; and an open position, wherein when the second fluid entrance is in the open position, the fluid flows through the second fluid entrance into the multi-stage centrifugal pump.

2. The ESP assembly of claim 1, wherein the second intake section comprises a sleeve slideable between the closed position and the open position.

3. The ESP assembly of claim 2, further comprising a pressurizing pump hydraulically coupled to the sleeve by a hydraulic hose, the pressurizing pump adjusting a pressure of a space above the sliding sleeve to actuate the second fluid entrance between the closed position and the open position.

4. The ESP assembly of claim 2, wherein the second intake section comprises a spring compressed below the sleeve in the closed position such that the second fluid entrance fails open.

5. The ESP assembly of claim 1, wherein the filter comprises one of a slotted or perforated screen.

6. The ESP assembly of claim 1, wherein the filter comprises a porous media cartridge.

7. The ESP assembly of claim 1, further comprising an ESP motor rotatably coupled to the multi-stage centrifugal pump upstream of the ESP intake, the ESP motor operated by a variable speed drive (VSD), the VSD comprising a VSD controller user-interface, wherein actuation of the second fluid entrance is selectable by an operator, and wherein the VSD controller user-interface provides information determinative of the selection.

8. The ESP assembly of claim 7, wherein the information comprises one of flow rate of the multi-stage centrifugal pump, ESP pressure or a combination thereof.

9. The ESP assembly of claim 7, wherein the information is provided to the VSD controller user-interface from downhole sensors proximate the ESP motor, the downhole sensors electrically coupled to the VSD controller user-interface.

10. An electric submersible pump (ESP) intake system comprising:

In Reply to Non-Final Office Action mailed Aug. 12, 2019 a filtered intake section in tandem with a sliding sleeve intake section, wherein the sliding sleeve intake section has a closed initial state and is selectively actuatable to an open position when the filtered intake section becomes at least partially clogged; and the filtered intake serving as a fluid intake to an ESP pump when the sliding sleeve intake is in the closed initial state; and the sliding sleeve intake section serving as the fluid intake to the ESP pump when the sliding sleeve intake section is in the open position.

11. The ESP intake system of claim 10, wherein the filtered intake section and the sliding sleeve intake section are coupled between the ESP pump and an ESP motor in a hydraulically fractured well.

12. The ESP intake system of claim 11, wherein the filtered intake section becomes at least partially clogged by proppant.

13. The ESP intake system of claim 11, further comprising a hydraulic pump at a surface of the hydraulically fractured well, wherein the sliding sleeve intake is actuated between the closed initial state and the open position by the hydraulic pump.

14. The ESP intake system of claim 13, wherein the hydraulic pump is operatively coupled to a variable speed drive (VSD) controller, the VSD controller varying one of a frequency, a speed or a combination thereof of the ESP motor.

15. The ESP intake system of claim 10, wherein the filtered intake section and the sliding sleeve intake section are located in a vertical downhole ESP assembly, and the filtered intake section is attached below the sliding sleeve intake section.

16. The ESP intake system of claim 10, wherein there are a plurality of filtered intake sections and a plurality of sliding sleeve intake sections coupled together in tandem.

17. An electric submersible pump (ESP) intake method comprising:

operating an ESP pump downhole in a well comprising abrasive-laden fluid, the ESP pump comprising:

a filtered intake section comprising a filter; and an actuatable intake section, the actuatable intake section in a closed position during initial operation of the ESP pump and actuatable open;

employing the filtered intake section as a first fluid entrance into the ESP pump;

monitoring information from ESP sensors during employment of the first fluid entrance to identify clogging of the filter; and opening the actuatable intake section upon the clogging so identified such that the actuatable intake section serves as a second fluid entrance into the ESP pump.

18. The ESP intake method of claim 17, wherein the actuatable intake section comprises intake ports and is actuatable open by aligning apertures in a sliding sleeve of the actuatable intake section with the intake ports.

19. The ESP intake method of claim 18, further comprising hydraulically actuating the sliding sleeve using a hydraulic pump at a surface of the well.

20. The ESP intake method of claim 19, wherein the information is monitored using a VSD controller user-interface.

* * * * *